US006401800B1

(12) United States Patent
Guetelbauer et al.

(10) Patent No.: US 6,401,800 B1
(45) Date of Patent: Jun. 11, 2002

(54) DEVICE AND METHOD FOR CONTINUOUS CASTING OF WORKPIECES

(75) Inventors: Franz Guetelbauer, Neufahrn; Hartmut Hoffmann, Bad Wimpfen; Andreas Poellmann, Herrenberg; Volker Thoms, Calw, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/321,082

(22) Filed: May 28, 1999

(30) Foreign Application Priority Data

May 28, 1998 (DE) ..... 198 23 797

(51) Int. Cl.[7] ..... B22D 11/00; B22D 11/124

(52) U.S. Cl. ..... 164/465; 164/421; 164/485; 164/443

(58) Field of Search ..... 164/485, 443, 164/465, 421, 348

(56) References Cited

U.S. PATENT DOCUMENTS

| | | | | | |
|---|---|---|---|---|---|
| 3,987,655 | A | | 10/1976 | Myotte | 72/60 |
| 4,308,908 | A | * | 1/1982 | Sevastakis | 164/464 |
| 4,565,236 | A | | 1/1986 | Masui et al. | 164/459 |
| 4,798,237 | A | * | 1/1989 | Nakano | 164/255 |
| 5,117,895 | A | * | 6/1992 | Hargassner et al. | 164/443 |
| 5,213,149 | A | * | 5/1993 | Ruff et al. | 164/122 |
| 5,404,932 | A | * | 4/1995 | Koivisto et al. | 164/443 |
| 5,771,958 | A | * | 6/1998 | Sears, Jr. | 164/443 |
| 6,044,898 | A | * | 4/2000 | Pleschiutschnigg | 164/485 |

FOREIGN PATENT DOCUMENTS

| | | | | |
|---|---|---|---|---|
| AT | 396 439 | | 9/1993 | |
| DE | 19 00 882 | | 8/1970 | |
| DE | 26 50 016 | | 5/1977 | |
| DE | 32 04 339 | | 12/1982 | |
| DE | 31 50 684 | | 7/1983 | |
| DE | 195 29 931 | | 4/1997 | |
| DE | 195 49 275 | | 4/1997 | |
| WO | 97/24196 | * | 7/1997 | B22D/11/04 |

* cited by examiner

*Primary Examiner*—M. Alexandra Elve
*Assistant Examiner*—Kevin P. Kerns
(74) *Attorney, Agent, or Firm*—Crowell & Moring LLP

(57) ABSTRACT

A device for continuous. casting of workpieces has a melting crucible, a filling device, and a forming tool provided with a temperature control system. The temperature control system of the forming tool is designed so that areas of the workpiece to be manufactured that have a greater wall thickness can be cooled to a greater degree and areas of the workpiece to be manufactured with a lesser wall thickness can be cooled to a lesser degree and/or heated. The solid-liquid interface of the workpiece is located in a plane that is at least approximately perpendicular to the vertical axis of the workpiece.

21 Claims, 1 Drawing Sheet

DEVICE AND METHOD FOR CONTINUOUS CASTING OF WORKPIECES

BACKGROUND AND SUMMARY OF THE INVENTION

This application claims the priority of German patent 198 23 797.9-24, filed May 28, 1998, the disclosure of which is expressly incorporated by reference herein.

The invention relates to a device for continuous casting of workpieces, using a melting crucible, a filling device, and a forming tool provided with a temperature control system. The invention also relates to a method for continuous casting of workpieces with a melt being fed to a melting crucible, and with the melt entering a forming tool provided with a temperature control system through a filling device.

A platemold for producing strands of steel is known from German patent document DE 195 29931 C1, in which the broad side walls have at least three adjacent, mutually independent cooling sections. As a result it should be possible to make a differentiated statement about the partial heat flux across the width of the mold.

German patent document DE 32 04 339 A1 describes a continuous casting mold for casting support blanks that is provided with coolant lines.

Another device as well as a corresponding method are known from German patent document DE-OS 26 50 016. In this method, referred to as extrusion, an endless strand is pulled out as a workpiece from a liquid metal in a forming tool, referred to in this case as an extrusion die.

A method for manufacturing pipes, wires, etc. is known from German patent document DE-PS 429 217 which links the familiar centrifugal casting method with the likewise known extrusion molding method.

Moreover, German patent document DE 31 50 684 C2 describes a semi-continuous continuous casting process for metals with a strand to be pulled out and upward. With the very complex method described in this document, assurance is to be provided that strands of excellent quality and free of segregation can be manufactured from even complex alloys with a high production efficiency.

It is disadvantageously no t possible with this method and device to manufacture workpieces with complicated cross sections that have different thicknesses, in particular by continuous casting.

The continuous casting and extrusion molding methods are also known from the general prior art in addition to the documents cited above. In order to manufacture any profiles, even those that can be partially very complex reflecting their applications, a semifinished product is usually manufactured by continuous casting and then given its final shape by extrusion molding.

The high manufacturing expense and the associated high costs of this process and the devices used for the purpose however are very disadvantageous.

Hence, an object of the present invention is to provide a device and a method for continuous casting with which workpieces with complex cross, sections, with different thicknesses or wall thicknesses that change over the cross section, can be manufactured.

This and other objects have been achieved according to the present invention by providing a device for continuous casting of a workpiece, comprising: a melting crucible; a filling device; and a forming tool provided with a temperature control system, the temperature control system of the forming tool being designed such that areas of a workpiece to be manufactured that have a greater wall thickness can be cooled to a greater degree and areas of the workpiece to be manufactured that have a lesser wall thickness can be cooled to a lesser degree and/or heated such that a solid-liquid interface of the workpiece lies in a plane that is at least approximately perpendicular to the vertical axis of workpiece.

This and other objects have also been achieved according to the present invention by providing a method for continuous casting of a workpiece defining at least one interior recess, the workpiece having a varying wall thickness, comprising: feeding a melt to a forming tool provided with a temperature control system; and cooling areas of the workpiece to be manufactured having a greater wall thickness to a greater degree in the forming tool than areas of the workpiece to be manufactured having a lesser wall thickness.

This and other objects have also been achieved according to the present invention by providing a forming tool for a continuous casting machine, comprising: a forming tool defining an opening corresponding to a cross-section of a workpiece to be cast, the opening including wider openings corresponding to areas of the workpiece to be cast having a greater wall thickness and narrower openings corresponding to areas of the workpiece to be cast having a lesser wall thickness; a temperature control system provided in the forming tool, the temperature control system being designed to cool the forming tool to a greater degree adjacent the wider openings, the temperature control system being designed to at least one of (a) cool the forming tool to a lesser degree, and (b) heat the forming tool, adjacent the narrower openings.

This and other objects have also been achieved according to the present invention by providing a method of controlling the solidification of a melt in a continuous casting machine having a forming tool defining an opening corresponding to a cross-section of a workpiece to be cast, the opening including wider openings corresponding to areas of the workpiece to be cast having a greater wall thickness and narrower openings corresponding to areas of the workpiece to be cast having a lesser wall thickness, the method comprising: cooling the forming tool to a greater degree adjacent the wider openings; and at least one of (a) cooling the forming tool to a lesser degree, and (b) heating the forming tool, adjacent the narrower openings.

This and other objects have also been achieved according to the present invention by providing a system for controlling the solidification of a melt in a continuous casting machine having a forming tool defining an opening corresponding to a cross-section of a workpiece to be cast, the opening including wider openings corresponding to areas of the workpiece to be cast having a greater wall thickness and narrower openings corresponding to areas of the workpiece to be cast having a lesser wall thickness, the system comprising: means for cooling the forming tool to a greater degree adjacent the wider openings; and means for: at least one of (a) cooling the forming tool to a lesser degree, and (b) heating the forming tool, adjacent the narrower openings.

With the design of the temperature control system of the forming tool according to the invention, areas of the workpiece to be manufactured with a greater wall thickness can be cooled to a greater degree and areas with lesser wall thicknesses can be cooled to a lesser degree, or even heated. As a result, it is possible to manufacture workpieces with any cross section, especially with a complex cross section, by continuous casting, since the solid-liquid interface, in other words the area in which the melt changes into the finished workpiece, despite the different wall thicknesses, is distributed uniformly over the cross section. One could even speak of a symmetrical course of the solid-liquid interface over the cross section, in which the average of the areas that have last hardened is located like a resultant of forces at the center of the workpiece. Advantageously, the cast strand now emerges in a straight line from the forming tool.

The previous problem that areas with a greater wall thickness take longer to set than areas with a lesser wall thickness and therefore a very considerable delay would occur at the strand emerging from the mold therefore no longer applies.

The method according to the invention makes it possible to eliminate the extrusion that was previously required in addition to continuous casting to make workpieces with more complex cross sections.

According to certain preferred embodiments, the temperature-control system of the forming tool has coolant lines and optionally also heating lines.

According to certain preferred embodiments, a greater concentration of coolant lines is provided in areas of the forming tool proximate portions of the workpiece to be manufactured that have a greater wall thickness than in areas of the workpiece to be manufactured with a lesser wall thickness.

According to certain preferred embodiments, coolant lines having a larger diameter are provided in areas of the forming tool proximate portions of the workpiece to be manufactured that have a greater wall thickness than in areas of the workpiece to be manufactured with a lesser wall thickness.

By adjusting the number or the size (e.g., the diameter) of the coolant lines or the heating lines, a simple change can be made to the design of the temperature-control system according to the invention.

According to certain preferred embodiments, the forming tool is designed with a greater height in areas with a greater wall thickness of the workpiece to be manufactured than in areas with a lesser wall thickness of the workpiece to be manufactured.

According to certain preferred embodiments, adjacent areas of the forming tool with a lesser height, an in-flow area is provided in the filling device, with the height of this area corresponding to the difference between the height of higher areas of the forming,tool,and the height of flatter areas of the forming tool.

The reduced height or length of the forming tool in workpiece areas with reduced wall thicknesses produces a reduced effective height of the temperature control system, which therefore produces a reduced cooling effect in the areas of the workpiece to be manufactured that have a reduced wall thickness.

Other objects, advantages and novel features of the present invention will become apparent from the following detailed description of the invention when considered in conjunction with the accompanying drawings.

DETAILED DESCRIPTION OF THE DRAWINGS

Figure 1:
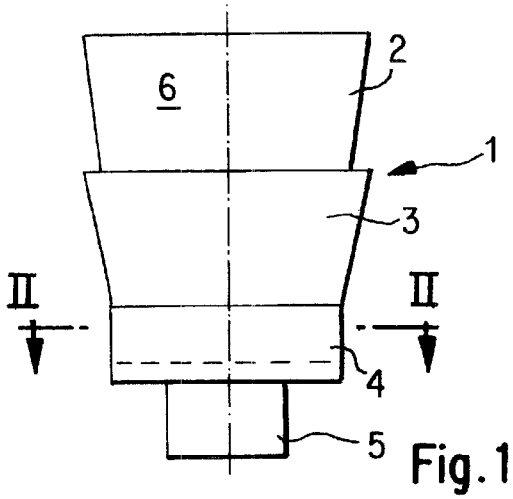
FIG. 1 is a schematic front view of a device for continuous casting, according to a preferred embodiment of the present invention.

According to FIG. 1, a device 1 is shown for continuous casting with a melting crucible 2, a filling device 3, and a forming tool 4. At the underside of forming tool 41 a workpiece 5 manufactured by continuous casting emerges or is withdrawn by suitable devices.

Melting crucible 2 is filled at the top with a melt 6 which in this case enters forming tool 4 through the filling device 3 under its own hydrostatic pressure. In a manner not shown, it would also be possible to supply melt 6 by using a pulsating pressure generator, a plunger or an extruder for example, into forming tool 4. This would be particularly advisable if higher pressing forces were required. In both cases, the melt 6 could also be supplied in the horizontal direction. Workpiece 5 is manufactured in forming tool 4 from melt 6 by setting.

Figure 2:
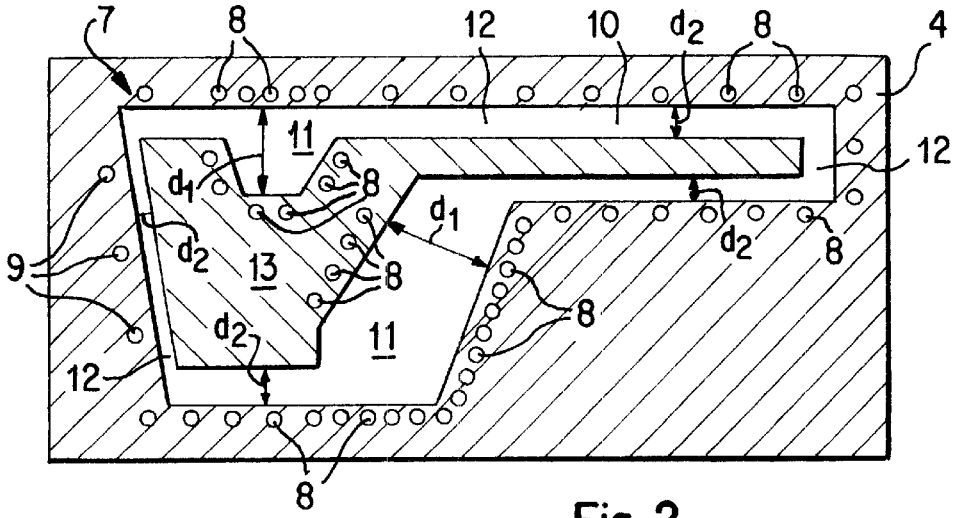
FIG. 2 is a sectional view of the forming tool of FIG. 1 taken along line II—II in FIG. 1.

FIG. 2 shows a section through forming tool 4 which is provided in a manner known of itself with a temperature control system 7. Temperature control system 7 has coolant lines 8 and in the present case, heating lines 9 as well. Temperature control system 7 is intended to cool melt 6 or workpiece 5 so that a uniform solid-liquid interface forms at the underside of forming tool 4 before workpiece 5 emerges and no delay of workpiece 5 occurs. Instead, the workpiece 5 emerges in a straight line from forming tool 4.

Workpiece 5, formed by a cavity 10 in forming tool 4, has a cross section with areas 11 with a greater wall thickness d1 and areas 12 with a lesser wall thickness d2. In the areas 11 with the greater wall thickness d1, more coolant lines 8 are provided than in the areas 12 with the lesser wall thickness d2, where heating lines 9 can also be located if necessary.

This is the case because the areas 11 with the greater wall thickness d1 require a longer setting time than the areas 12 with the lesser wall thickness d2. Coolant lines 8 and heating lines 9 must be arranged and adjusted to one another so that workpiece 5 sets uniformly. However, for example in the areas 11 of the walls against the forming tool 4, setting will always occur faster than in the middle of the areas 11, so that the solid-liquid interface will be in the shape of a parabola at this location. At the outlet of forming tool 4, at least the outer shell of the workpiece 5 sets, but a workpiece 5 that has completely set can, however, already be present in forming tool 4.

Workpiece 5 in this case is a hollow profile with a recess in its interior, so that forming tool 4 has a mandrel 13 which is known and which likewise may be provided with coolant lines 8 and optionally also with heating lines 9. Instead of mandrel 13, a known bridge die could be provided as an alternative. This die could also be provided with coolant lines 8 and possibly with heating lines 9.

In an embodiment that is not shown in further detail, the coolant lines 9 in areas 11 with a greater wall thickness d1 may have a larger diameter than the coolant lines 8 in the areas 12 with a lesser wall thickness d2. It is also contemplated to adjust the volume flow in the coolant lines 8 and/or the heating lines 9 to the required cooling of workpiece 5.

With the two systems described, areas 11 of workpiece 5 with greater wall thickness d1 are cooled to a greater degree then the areas 12 of workpiece 5 with lesser wall thickness d2. As a consequence of the uniformly setting layer of workpiece 5 that results at the lower edge of forming tool 4, workpieces 5 with any cross section can be manufactured using forming tool 4, especially those with different wall thicknesses that change over the cross section and with at least one cavity in their interiors.

Figure 3:
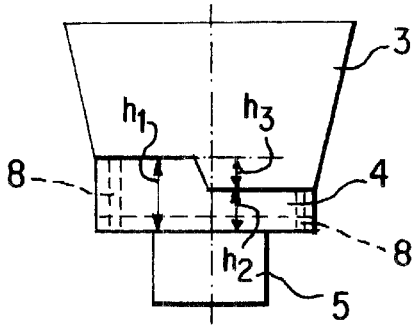
FIG. 3 is a schematic front view of a device for continuous casting according to a second preferred embodiment of the present invention.

FIG. 3 shows another embodiment of forming tool 4 with coolant lines 8 which in this case have different heights or lengths in order to take into account the different setting times for the different wall thicknesses d1 and d2 of workpiece 5. For reasons of clarity, cavity 10 and mandrel 13 of forming tool 4 are not shown in FIG. 3. In the areas 11 (not shown in further detail in FIG. 3) with the greater wall thickness d1 of workpiece 5 to be manufactured, forming tool 4 has a greater height hi than in the areas 12 with the lesser wall thickness d2, where forming tool 4 has only a height of h2. A difference in the heights h1 and h2 is represented by h3.

In the case of workpieces 5 with very complicated cross sections, of course, additional height differences of the corresponding areas can results so that in the final analysis a forming tool 4 results with a contour completely adapted to the workpiece 5.

In areas 11, therefore, there is a greater cooling effect by the longer coolant lines 8 than in the areas 12 which also have shorter coolant lines 8, because of their lesser height h2.

Thus, in this forming tool 4 as well, workpieces 5 with any cross section can also be manufactured by continuous casting and an additional workstep, namely extrusion molding, is no longer required.

Of course it is also possible to combine both different heights of forming tool 4 and the distribution of the coolant lines 8 and heating lines 9 described above with one another in a forming tool 4.

The foregoing disclosure :has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for continuous casting of a workpiece having an interior recess with walls of varying wall thickness, said device comprising:

a melting crucible which provides a flow of a melt;

a filling device which guides said melt flow;

a forming tool which continuously receives said melt flow from said filling device, and is arranged to continuously form said workpiece as said melt flow passes through said forming tool; wherein said forming tool is provided with a temperature control system that adjusts a temperature of said walls based on their thickness; and said adjustment of temperature is performed such that areas of the workpiece having a relatively greater wall thickness are cooled to a relatively greater degree in comparison to areas of the workpiece having a relatively lesser wall thickness, which are cooled to a relatively lesser degree and/or heated.

2. A device according to claim 1, wherein said temperature-control system of the forming tool comprises at least one of coolant lines and heating lines.

3. A device according to claim 2, wherein a larger number of coolant lines is provided at said areas of the workpiece having a relatively greater wall thickness than at said areas of the workpiece having a relatively lesser wall thickness.

4. A device according to claim 2, wherein at said areas of the workpiece that have a relatively greater wall thickness, said coolant lines have a relatively larger diameter than at said areas the of workpiece that have a relatively lesser wall thickness, or said heating lines are provided at said areas of the workpiece that have a relatively lesser wall thickness.

5. A device according to claim 1, wherein said forming tool has a relatively greater height at said areas of the workpiece that have a relatively greater wall thickness in comparison to a relatively lesser height of said forming tool at said areas of the workpiece that have a relatively lesser wall thickness.

6. A device according to claim 5, wherein in said areas with a relatively lesser height, an in-flow area is provided in said filling device, a height of said in-flow area corresponding to the difference between the relatively greater height and the relatively lesser height of the forming tool.

7. A device according to claim 1, wherein said forming tool has a mandrel that has coolant lines.

8. A device according to claim 7, wherein said mandrel has heating lines.

9. A device according to claim 1, wherein a hydrostatic pressure of said melt feeds said melt into said forming tool.

10. A device according to claim 1, further comprising a pulsating plunger to feed said melt into said forming tool.

11. A method for continuous casting of a workpiece defining at least one interior recess, said workpiece having a varying wall thickness, said method comprising:

continuously feeding a melt through a forming tool provided with a temperature control system, said melt hardening as it passes through said forming tool, continuously forming said workpiece; and cooling areas of the workpiece to be manufactured having a relatively greater wall thickness to a relatively greater degree in the forming tool in comparison to areas of the workpiece to be manufactured having a relatively lesser wall thickness.

12. A forming tool for a continuous casting machine, comprising:

a forming tool adapted to receive a melt flow of molten material and to continuously form said workpiece as said melt flow passes through said forming tool, said forming tool having an opening corresponding to a cross-section of a workpiece to be cast, said opening including relatively wider openings corresponding to areas of the workpiece to be cast having a relatively greater wall thickness and relatively narrower openings corresponding to areas of the workpiece to be cast having a relatively lesser wall thickness;

a temperature control system provided in said forming tool, said temperature control system being operable to cool said melt flow to a relatively greater degree as it passes through said relatively wider openings, said temperature control system being operable to at least one of (a) cool said forming tool to a relatively lesser degree, and (b) heat said forming tool, adjacent said relatively narrower openings.

13. A forming tool according to claim 12, wherein said temperature-control system comprises at least one of coolant lines and heating lines defined in said forming tool.

14. A forming tool according to claim 13, wherein a relatively larger concentration of said coolant lines is provided at said relatively wider openings than at said relatively narrower openings.

15. A forming tool according to claim 13, wherein said coolant lines at said relatively wider openings have a relatively larger diameter in comparison to said coolant lines at said relatively narrower openings.

16. A forming tool according to claim 12, wherein said forming tool has a relatively greater height adjacent said relatively wider openings in comparison to a relatively lesser height adjacent said relatively narrower openings.

17. A method according to claim 12, further comprising controlling said temperature control system such that said melt solidifies at least approximately in a horizontal plane.

18. A method of controlling the solidification of a melt of molten material in a continuous casting machine having a forming tool adapted to receive the melt and to continuously form said workpiece as said melt passes through said forming tool, said forming tool having an opening corresponding to a cross-section of a workpiece to be cast, said opening including relatively wider openings corresponding to areas of the workpiece to be cast having a relatively greater wall thickness and relatively narrower openings corresponding to areas of the workpiece to be cast having a relatively lesser wall thickness, said method comprising:

cooling said forming tool to a relatively greater degree adjacent said relatively wider openings; and at least one of (a) cooling said forming tool to a relatively lesser degree, and (b) heating said forming tool, adjacent said relatively narrower openings.

19. A method according to claim 18, wherein said act of cooling and said act of at least one of (a) cooling and (b) heating are controlled such that said melt solidifies at least approximately in a horizontal plane.

20. A system for controlling the solidification of a melt of molten material in a continuous casting machine having a forming tool adapted to receive the melt and to continuously form said workpiece as said melt passes through said forming tool, said forming tool having an opening corresponding to a cross-section of a workpiece to be cast, said opening including relatively wider openings corresponding to areas of the workpiece to be cast having a relatively greater wall thickness and relatively narrower openings corresponding to areas of the workpiece to be cast having a relatively lesser wall thickness, said system comprising:

means for cooling said forming tool to a relatively greater degree adjacent said relatively wider openings; and means for at least one of (a) cooling said forming tool to a relatively lesser degree, and (b) heating said forming tool, adjacent said relatively narrower openings.

21. A system according to claim 20, wherein said means for cooling and said means for at least one of (a) cooling and (b) heating are controlled such that said melt solidifies at least approximately in a horizontal plane.

* * * * *